United States Patent [19]

Bartels

[11] 4,232,458

[45] Nov. 11, 1980

[54] SHOE

[75] Inventor: Bruce E. Bartels, Cambridge, Canada

[73] Assignee: Wheelabrator Corp. of Canada, Ontario, Canada

[21] Appl. No.: 886,042

[22] Filed: Mar. 13, 1978

[51] Int. Cl.[2] ..... A43B 23/00

[52] U.S. Cl. ..... 36/45; 139/410; 139/413

[58] Field of Search ..... 139/408, 409, 410, 411, 139/412, 413, 414, 415; 36/45, 51

[56] References Cited

U.S. PATENT DOCUMENTS

| | | | |
|---|---|---|---|
| 685,524 | 10/1901 | McIlwain | 139/410 |
| 2,118,658 | 5/1938 | Sayers | 139/413 |
| 2,788,023 | 4/1957 | Renaud | 139/410 |
| 2,857,654 | 10/1958 | Sexton | 139/413 |
| 3,104,684 | 9/1963 | Seltzer | 139/413 |
| 3,583,081 | 6/1971 | Hayashi | 36/45 |
| 4,067,124 | 1/1978 | Sikora | 36/45 |

FOREIGN PATENT DOCUMENTS

| | | | |
|---|---|---|---|
| 825605 | 12/1937 | France | 139/408 |

*Primary Examiner*—Henry Jaudon

*Attorney, Agent, or Firm*—Murray and Whisenhunt

[57] ABSTRACT

The present invention provides a breathable fabric comprising a woven first layer and a woven second layer said first layer at spaced points both longitudinally and laterally of said fabric being interwoven with said second layer providing tie-in points of said first layer to said second layer, the spacing between the tie-in points being sufficiently close to provide that the layers are always in contact with each other over the whole area of the adjacent surfaces.

15 Claims, 3 Drawing Figures

SHOE

The present invention relates to a fabric, and in particular, the present invention relates to a breathable fabric having two layers which layers are closely held together in continuous contact with each other, such fabric being particularly suitable for the use in the manufacture of uppers of athletic footwear such as football shoes, running shoes and baseball shoes as well as casual footwear.

By the term "breathable" as used herein in respect of the fabric, is meant a fabric which allows air to pass freely through all parts thereof.

Heretofore, fabric used in the manufacture of such uppers has comprised a pair of layers, namely a face layer which may be formed inter alia of plain woven nylon bulk fibres which serves as a wear-resistant layer and a lining layer which is usually soft and pliable and serves to provide for the comfort of the wearer of the shoe. Such liner has heretofore comprised foamed plastic material such as polyurethane which may also have an inner face of, inter alia, terry cloth or similar cloth laminated thereto. This liner besides providing for the comfort of the foot also gives body to the fabric. Such lamination may be kiss lamination or lamination by means of adhesives.

Another fabric which has been used in the manufacture of such uppers has also comprised a pair of layers, usually one knitted, namely the face layer and one woven which are laminated together with an adhesive, the laminated fabric being present in the upper with the knitted layer outermost. For this purpose the knitted fabric is formed from a rugged wear-resistant thermoplastic fibre while the woven fabric is formed of a soft thermoplastic fibre, the thermoplastic fibres allowing for subsequent heat cutting of the fabric producing sealed edges. It is found however, that this fabric does not normally have sufficient body and again in the upper an inner layer is laminated to the woven fabric such as a leather layer.

A serious drawback with all these materials is that they are not breathable and thus are not particularly desirable for athletic footwear and footwear in general. In such footwear it is desirable, to maintain the coolness of the foot of the wearer for the uppers to be breathable. Further, particularly with the fabric comprising the woven face layer and the woven inner layer the fabric readily delaminates which is of particular importance when the fabric of the upper is accidentally cut, worn or otherwise ruptured. Again, as the fabric for use in such uppers is desirably air permeable, i.e., breathable, the presence of the laminating adhesive detracts from any permeability and the presence of the leather layer to provide body for the fabric in the upper again detracts from its breathability.

The present invention provides a breathable fabric having two woven layers which is extremely difficult to delaminate, does not use adhesives for lamination and further, provides for optimum air permeability, i.e., breathability, has good body and due to its structure provides for the face layer, i.e., the outer layer, to have a cosmetic effect in particular, a ruggedness which makes the fabric highly suitable for use in footwear particularly athletic footwear.

According to the present invention therefore there is provided a breathable fabric comprising a woven first layer and a woven second layer, said first layer at spaced points both longitudinally and laterally of said fabric being interwoven with said second layer to provide discrete tie-in points of said first layer to said second layer, the spacing between the tie-in points being sufficiently close to provide that the layers are always in contact with each other over the whole area of the adjacent surfaces.

The fabric of the present invention may be prepared upon conventional looms, suitably on a double beam loom, such that with regular periodicity the first layer is interwoven into the second layer to provide discrete tie-in points. The spacing both laterally and longitudinally of the fabric between the tie-in points is such as to ensure that the two layers are kept in continuous contact with each other over the whole area of the fabric without any wrinkling and looseness of the layers between the tie-in points. Suitably, for ease of manufacture the tie-in points are equi-spaced both longitudinally and laterally of the fabric to provide a square configuration with the spacing between the tie-in points desirably being not greater than about 9/16 of an inch, and preferably in the range 2/16 to 4/16 of an inch square. However, depending upon the particular weaving which is performed it is not necessary for the tie-in points to have a square configuration and any other suitable configuration can be chosen, as required, it only being required that the tie-in points, whatever their configuration, be sufficiently closely spaced so as to maintain the two fabrics in complete contact with each other as set forth above. The presence of the tie-ins gives the fabric strength and the use of tie-ins avoids the presence of any adhesive for lamination and thus, enhances the breathability of the fabric.

The weave of each layer of the fabric is not critical and may be for example, a twill weave although it has been found desirable at least from an appearance point of view to have both layers of a plain weave. The tightness of the weave in each layer of the fabric is not critical, but from a strength point of view and an appearance point of view, the weaves should have sufficient picks and ends per inch to provide a strong fabric which is preferably self-supporting, i.e., does not collapse and show a sleazy effect and thus has body. Further, the number of picks and ends should be sufficient at least in the inner layer from an appearance point of view to cover the outer layer which is usually a dyed layer. Thus, the number of counts and picks per inch should be as high as possible allowing for the air permeability of the fabric and the actual number will of course depend upon the Denier of fibres and filaments from which the layer is made.

The layers of the fabric are desirably made from suitable thermoplastic materials, particularly synthetic resins such as olefin polymers, e.g., polyethylene and polypropylene, amide polymers such as nylon, vinyl chloride of vinylidene chloride polymers such as saran and ester polymers such as polyethylene terephthalate. Further, for the use in uppers of athletic shoes and shoes in general, the outer layer should be formed from a wear-resistant, strong, rugged and preferably dyable thermoplastic material such as nylon, a particularly desirable material being bulked continuous nylon fibres. The inner layer should be of a softer material, such as polyester for example, that sold under the trademark "Terylene". Such a material is generally undyeable thus producing a white liner in the shoe which is desirable in footwear, particularly athletic footwear. It is preferred from an appearance point of view that the first layer is the outer layer which ties into the inner layer thus providing slight depressions in the outer layer enhancing the rugged cosmetic effect thereof. The body of the fabric may also be enhanced by sizing with a water soluble base, suitably using a padding technique to remove excess sizing agent and then heat setting. This technique does not significantly reduce the breathability of the fabric.

A particularly desirable fabric is one in which the first layer is a plain weave nylon fibre with from about 24 to 40 ends per inch and 16 to 25 picks greige (off the loom) per inch, and the second layer is a plain weave fibre with from 37 to 59 ends per inch and 22 to 35 picks greige per inch with tie point spacing of not more than 9/16" square. Suitably, this material is dyed and heat set. A particularly preferable material which is a fabric in which the first layer is a plain weave bulk nylon fibre with 20 ends per inch and 32 picks griege per inch and the second layer is a plain weave polyester, e.g. polyethylene teraphthalate fibre with 49 ends per inch and 20 picks greige per inch with tie point spacing of 3/16" square. A nylon fibre, suitably having a Denier of 1300 and the polyester, e.g. polyethylene teraphthalate suitably being 2/20 cc (cotton count) terylene.

The fabric of the present invention, as aforesaid, can be manufactured on a conventional loom, preferably a double beam loom one beam being for the warp of the nylon and the other beam being for the warp of the polyester, e.g. terylene. Suitably, the loom has a plurality of frames with the warps of the nylon which are to be interwoven at the tie points with the terylene being carried by the heddles of a particular frame. In operation of the loom the layers of the nylon and the polyester, e.g. terylene are woven separately and alternately, with the frames carrying the warps of the nylon being disposed such that these warps lie outside the shed formed by the terylene warps during the weaving of the terylene layer and vice versa. For producing the tie in points the frame carrying the warps of nylon to be tied into the terylene layer at the appropriate time instead of being moved out of the shed which is formed by the polyester, e.g. terylene warps is moved to form part of the shed thereby being interwoven with the terylene layer at the tie in points. The particular sequence of weaving the layers is not critical and depends upon the particular loom used. A suitable loom is a Crompton & Knowles W-3A loom, with 12 harnesses and a double beam set up.

Thus, the present invention provides a fabric for use in the footwear industry both athletic and casual, which is a double woven fabric which provides ventilation or breathability and thus, provides a cool-type product and at the same time provides for a face and back fabric woven together which eliminates the necessity for cementing, laminating or stitching a back fabric to a face fabric, the back fabric in the present fabric acting as a liner thereby reducing costs and weight.

The present invention will be further illustrated by way of the accompanying drawings, in which.

Figure 1:
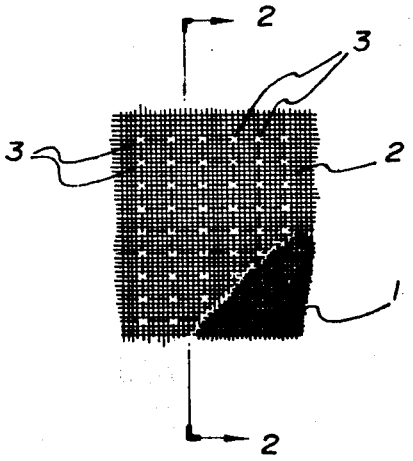
FIG. 1 is a plan view partially broken away of a piece of fabric according to one embodiment of the present invention.

Referring to FIG. 1, the double-woven fabric comprises a face layer 1 of dyed plain woven 1300 Denier bulked continuous nylon fibre (supplied by DuPont de Nemours & Co.) and a back or lining layer 2 of plain woven polyester such as polyethylene terephthalate fibres (supplied under the trademark Terylene) of 2/20 cc (cotton count). The layers 1 and 2 are tied together at evenly spaced 3/16" square tie-in points 3 by the picks of the face layer being interwoven with both ends of the face layer and ends of the back layer (see FIG. 2) thereby tying the back layer to the face layer at these points. The fabric after weaving and before dyeing and heat setting has a count 32W×20F greige for the nylon layer 1 and 49W×29F greige for the polyester, e.g. polyethylene terephthalate layer. After heat setting and dyeing the counts register 38W and 20F and 51W and 29F for the nylon polyester, e.g. polyethylene terephthalate respectively.

The visual effects on the face layer is a slight bar warp-wise which is due to the pulling of the yarns to tie in to the back layer. These bars are at times, practically unnoticeable depending on the colour of the face layer. The back cloth shows the tie-points as "holes", due to the visibility of the colour of the face layer. As the polyester does not pick up the dye, it remains white and therefore, the "holes" appearance created by this method of weaving gives the impression of "ventilation" through the fabric. Therefore, the cosmetics attained are advantageous commerically.

Figure 2:
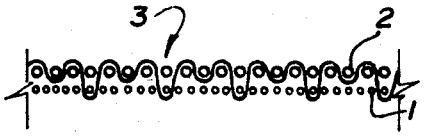
FIG. 2 is a detail section along the line 2—2 showing the disposition of the pick with respect to the ends of the fabric of FIG. 1 at a line of tie-ins.
Figure 3:
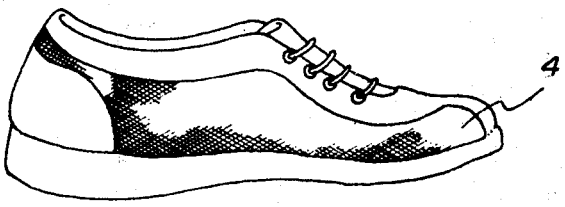
FIG. 3 is a perspective view of an athletic shoe containing the fabric of FIG. 1.

Referring to FIG. 3 the fabric of FIGS. 1 and 2 forms part of the upper of an athletic shoe 4 the rugged wear resistant dyed nylon face layer 1 being disposed on the outside of the shoe and the white undyed back Terylene layer forming a soft liner in the shoe.

The embodiments of the invention in which an exclusive property or privilege is claimed are defined as follows:

1. A shoe including an upper in which the upper is fabricated at least substantially from a breathable fabric comprising a woven fabric face layer having bulky warp and weft threads interlaced to define cross-over points, and a woven fabric back layer having fine warp and weft threads interlaced to define cross-over points, said face layer at spaced cross-over points thereof being interwoven with said back layer to provide discrete tie-in points of said face layer to said back layer, said spaced cross-over points being separated both longitudinally and laterally by intermediate cross-over points at which no interweaving between the fabric layers occurs, the interweaving at said tie-in points being by means of a single weft thread from one layer and a single warp thread from the other layers, the spacing between adjacent discrete tie-in points being at least 2/16" and not greater than 9/16" and sufficiently close to provide that the layers always remain in contact with each other over the whole area of their adjacent surfaces and have substantially no relative movement in use, and whereby said layers retain their separate identities and said fabric, when viewed from said face layer side, generally not having an interwoven appearance.

2. Shoe of claim 1, wherein said shoe is an athletic shoe.

3. A shoe as claimed in claim 1 in which the tie-in points are equi-spaced both longitudinally and laterally of the fabric.

4. A fabric as claimed in claim 3 in which the spacing of the tie-in points is not greater than about 9/16" square.

5. A shoe as claimed in claim 3 in which the spacing of the tie-in points is in the range 2/16 to 4/16" square.

6. A shoe as claimed in claim 1 in which the first and second layers are plain woven fabrics.

7. A shoe as claimed in claim 1 in which the layers are formed from fibres or filaments of thermoplastic material.

8. A shoe as claimed in claim 1 in which the layers are formed from layers of different thermoplastic resin fibres or filaments.

9. A shoe as claimed in claim 1 in which one of the layers is of nylon fibres and filaments and the other of the layers is of polyester fibres and filaments.

10. A shoe as claimed in claim 1 in which one of the layers is of fibres or filaments of nylon and the other of fibres or filaments of polyethylene terephthalate.

11. A shoe as claimed in claim 1 in which the first layer is of nylon fibres or filaments and the second layer is of polyethylene terephthalate fibres or filaments.

12. A shoe as claimed in claim 1 in which the first layer is a plain weave nylon fibre with from about 24 to 40 ends per inch and 16 to 25 picks greige per inch and the second layer is a plain weave polyethylene terephthalate with from 37 to 59 ends per inch and 22 to 35 picks greige per inch with a tie point spacing of not more than 9/16" square.

13. A shoe as claimed in claim 10 which has been dyed and heat set.

14. A shoe as claimed in claim 1 in which the first layer is a plain weave bulk nylon fibre with 20 ends per inch and 32 picks greige per inch and a Denier of 1300 and the second layer is a plain weave polyethylene terephthalate fibre with 49 ends per inch and 30 picks greige per inch and of 20/2 c/c, the tie point spacing being 3/16" square.

15. A shoe as claimed in claim 12 which is heat set and dyed.

* * * * *